United States Patent [19]

Burton

[11] 4,132,215

[45] Jan. 2, 1979

[54] BOW STRING RELEASE MECHANISM

[76] Inventor: Glenn A. Burton, 1103 Biscayne Dr., Little Rock, Ark. 72207

[21] Appl. No.: 801,658

[22] Filed: May 31, 1977

[51] Int. Cl.[2] ..... F41B 5/00

[52] U.S. Cl. ..... 124/35 A

[58] Field of Search ..... 124/35 A, 41 A, 24 R, 124/23 R, 86

[56] References Cited

U.S. PATENT DOCUMENTS

| | | | |
|---|---|---|---|
| 3,845,752 | 11/1974 | Barner | 124/35 A |
| 3,929,120 | 12/1975 | Barner | 124/35 A |
| 3,937,206 | 2/1976 | Wilson | 124/35 A |
| 3,952,720 | 4/1976 | Wilson | 124/35 A |
| 4,009,703 | 3/1977 | Cunningham | 124/35 A |
| 4,022,181 | 5/1977 | Fletcher | 124/35 A |

*Primary Examiner*—Richard C. Pinkham
*Assistant Examiner*—William R. Browne
*Attorney, Agent, or Firm*—Hill, Gross, Simpson, Van Santen, Steadman, Chiara & Simpson

[57] ABSTRACT

A bow string holder for use in archery having a grip member positionable in the palm of an archer's hand with a pivotable string retaining member which is adapted to directly or indirectly grip a bow string. The grip has a latch device latching the pivotable member in a bow string restraining position and a thumb actuated trigger for release of the latch. The latch device is in a housing separate from the grip member and receivable in a slot in one side of the grip member. The latch device has a latch that engages the end of the lever that holds the bow string or the bow string holding member when the latch device is being pulled to a cocked position. When the latch is actuated by a trigger the lever is permitted to pivot and release the bow string or the bow string holding member.

2 Claims, 14 Drawing Figures

BOW STRING RELEASE MECHANISM

BACKGROUND OF THE INVENTION

1. Field of the Invention

This invention relates to archery and more particularly to a bow string holder and to a trigger operated release mechanism.

2. Prior Art

In archery the bow string is normally gripped by the archer's fingers adjacent the point of attachment of the arrow to the string. Since the bow may require a very large force application to draw the string back, this creates a tremendous pressure on the archer's fingers over a very small area determined by the diameter of the bow string.

The bow string is released by opening the fingers in which case the string, being under great tension, will scrape off of the fingers. This can, upon repeated occurance, not only injure the fingers, but more importantly, in competitive or sport archery, any angulation change imparted to the arrow by the slipping of the bow string from the fingers can change the flight of the arrow.

In order to reduce the tension on the fingers and, in some instances, to reduce the likelihood of string deflection during release, it has been known to use bow string holders which are devices which can be held in the hand and which have means for attachment to the bow string.

However such prior art bow string holders have not been universally accepted for a number of reasons including the fact that some of them are too small, others are too cumbersome to hold and still others do not have an adequate release mechanism for releasing the bow string.

It would therefore be an advance in the art to provide a bow string holder and release mechanism which is comfortable in use, of a natural grip size and which is capable of gripping the bow string securely while releasing it selectively without the necessity of applying great force to activate the release and further without the release mechanism causing significant displacement of the bow string from the sighted position.

SUMMARY OF THE INVENTION

My invention overcomes the disadvantages of the prior art and provides a bow string holder and release mechanism. A grip member is receivable in the palm of an archer's hand with a front edge having ripple recesses for positioning of the fingers and a rear edge designed for comfortable gripping. A trigger actuated release mechanism or latch device is carried by the grip member and includes a housing attached to the grip member with a pivotable string retaining member positioned to close a slot at the front of the housing with a latch device having a latch member portion engageable with the retaining member mechanism to prevent release of the retaining member. The latch member is pivotable and has a trigger button projecting from the housing associated therewith. A spring acting against the latch member urges it into latching contact with the retaining member. An adjustable stop member cooperates with the latch member to provide for a hair trigger adjustment for the latch device.

The grip member may have a string loop attached thereto on a side opposite the thumb operable trigger button, the string loop being passable around a bow string and into the slot and engageable with the retaining member. Alternatively the bow string itself may extend into the slot and be engaged by the retaining member.

It is therefore an object of this invention to provide a superior bow string holder and release mechanism for use in archery.

It is another, more particular, object of this invention to provide a trigger activated release mechanism including a pivotable retaining member held in a closed position by planar engagement with a face of a pivoted latch member having a trigger button attached thereto with a spring biasing the latch member to an engaged position with the retaining member and an adjustable stop controlling the degree of face abutment between the latch member and the retaining member.

It is another specific object of this invention to provide a bow string holder and release device including a single hand grip member having a front edge contoured for positioning of fingers of the archer, a rear edge adopted to be received in the palm of the hand underlying portions of the thumb with the thumb extending along a side of the grip member, a trigger actuated latch device affixed to the grip member having a trigger underlying the thumb, the latch device having a front portion with a vertical slot area therein for receipt of a string, either the bow string, or a bow string gripping string, a pivotable retaining member at the front of the latch device closing the string receiving slot and pivotable to an open position allowing the string to withdraw from the slot, a latch member interior of the latch device capable of holding the retaining member in a slot closing position with a face end of the latch member in contact with an interior surface of the retaining member, a spring urging the latch member into contact with the retaining member, the trigger effective to counteract the spring to slip the latch member face off of the pivotable retaining member to allow the retaining member to pivot under the influence of the string received in the slot.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
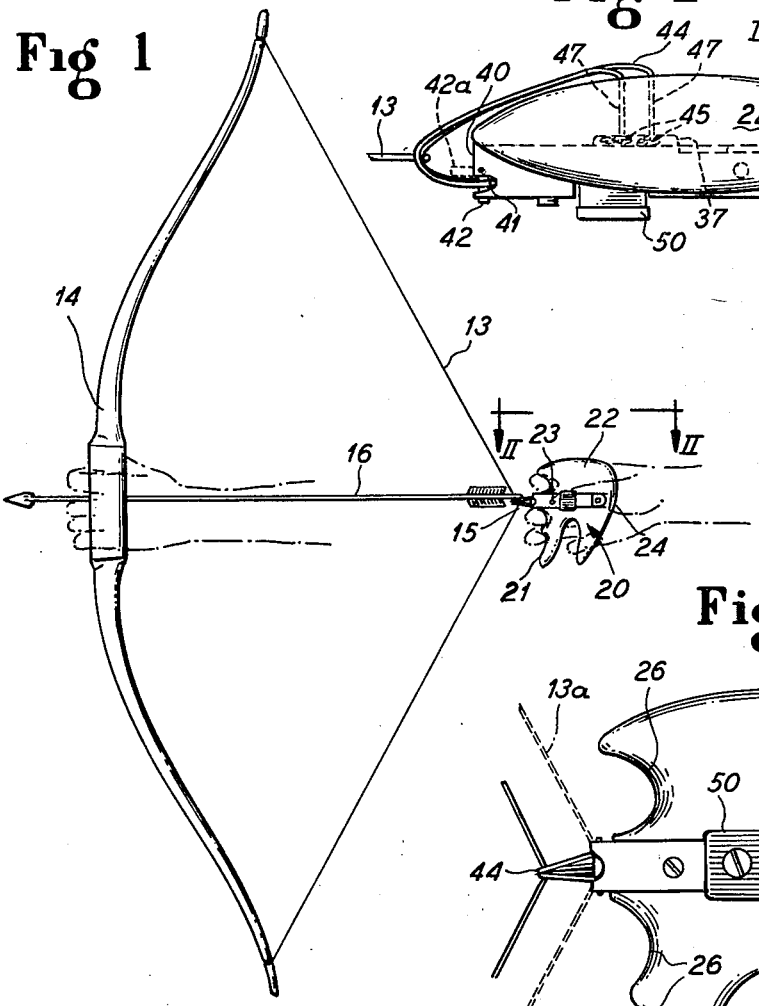
FIG. 1 is a plan view of a bow and arrow with an illustration of an archer holding the bow string holder of this invention.

As illustrated in FIG. 1, in archery the bow string 13 is tautly stretched backwardly away from the bow 14 and is normally gripped in an area 15 adjacent the attachment to the arrow 16. Oftentimes this is done by placing the index finger on one side of the arrow and the middle finger on the other side of the arrow. Since it is not unknown for bows to have draw weights well in excess of 50 pounds, the force of the relatively small diameter bow string against the fingers can be excessive.

My invention provides a holder 20 which can be attached to the bow string in the area 15 and which is conveniently sized and shaped to be received in the palm of the hand with at least three of the fingers of the archer resting against a front edge 21 of the holder, the edge 21 having a width dimension greater than that of the string. This reduces the force against the individual fingers, and more importantly creates a much secure grip.

The holder 20 includes the grip member 22 which is received in the palm of the hand and a latch device 23 which is attached directly or indirectly to the bow string and which is actuatable to release the bow string. The grip member is dimensioned to be conveniently held in the palm of the hand with the thumb 24 of the archer overlying one side of the grip member while the fingers are curled around the front edge 21.

Figure 2:
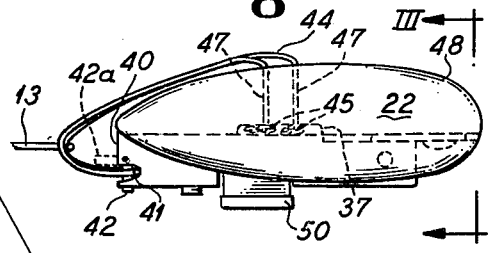
FIG. 2 is a top plan view of one embodiment of the bow string holder of this invention.

As best illustrated in FIG. 2, the front edge 21 has recesses 26 which are contoured to comfortably position the fingers while the back edge 27 is curved to comfortably fit within the palm against the pad of the hand at the base of the thumb. The bottom 28 may have a deep upwardly extending recess 29 which provides a second surface 30 spaced from the front edge 21 and slightly parallel thereto providing a surface against which the little finger may rest if desired.

Figure 3:
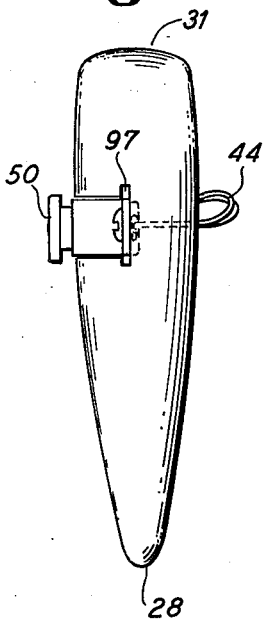
FIG. 3 is a back plan view taken along the lines III—III of FIG. 2.

As best illustrated in FIG. 2, the grip 22 may have a slightly teardrop shape front to back having a narrower front than rear with the recesses 26 increasing in width towards the rear of the recess. Further as shown in FIG. 3, the top 31 may be wider than the bottom 28.

One side face 36 of the grip 22 has a groove 37 therein extending from the front 26 to adjacent the rear 27 receiving the latch device 23. The latch device has a front edge 40 positioned adjacent the front edge 26 of the grip 22. The latch device includes slot 41 adjacent the front edge 40 which is closed by a pivotable string retaining member 42. Means are provided to unlatch the member 42 to allow it to pivot to open the slot 41.

In one embodiment, illustrated in FIG. 2, a looped string 44 may have its ends 45 affixed in the body of the grip and its loop receivable around the retaining member 42, in the slot 41. The bow string 13 can be positioned interior of the looped string between the string and the grip so that drawing the grip member backwardly away from the bow 14 will cause the bow string 13 to become taut and the bow to bend as the string 13 is held by the looped string 44. As illustrated in FIG. 2, the looped string 44 can be attached by having a bore or bores 47 through the side 48 of the grip opposite the side 36 which bores communicate to a deepened section of the bottom of the groove 37 where the string ends are tied off to a dimension greater than the bores 47.

Figure 4:
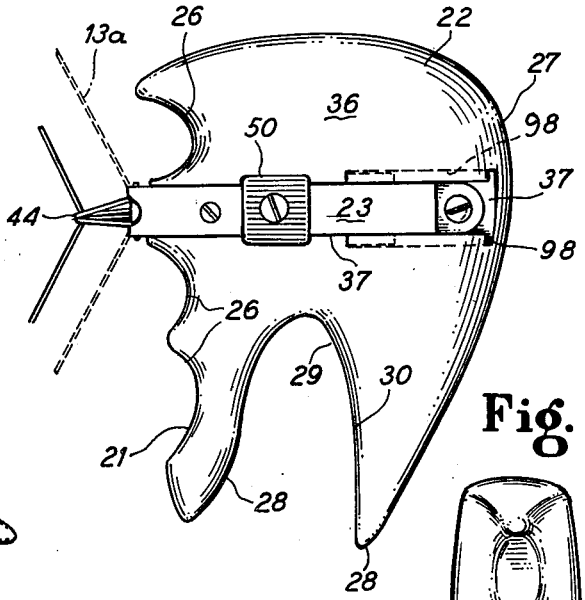
FIG. 4 is a side plan view of the bow string holder of this invention.
Figure 5:
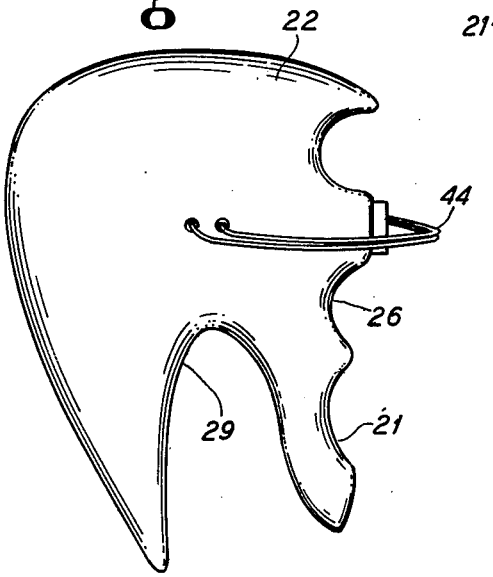
FIG. 5 is a view similar to FIG. 4 illustrating the opposite side of the holder.
Figure 6:
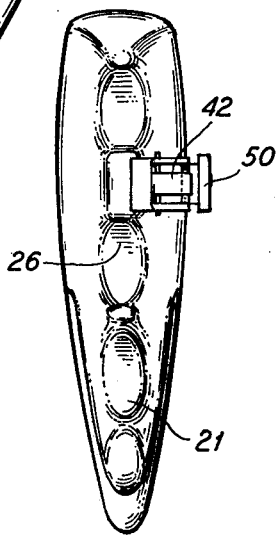
FIG. 6 is a front plan view of the bow string holder of this invention.
Figure 7:
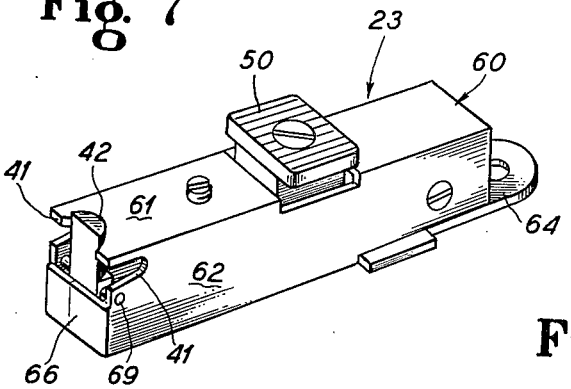
FIG. 7 is a perspective view of the latch device of this invention.
Figure 8:
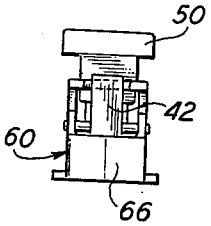
FIG. 8 is an elevational view of the latch device of this invention.

Alternatively, as indicated by the dotted line 13*a* of FIG. 4, the looped string 44 may be dispensed with and the bow string itself can be received around the part pivotable member.

Preferably a push button 50 or like release activator or trigger is attached to the latch device 23 and projects from the side 36 of the grip in a position to underlie the thumb. In this manner when release of the bow string is desired, all that is necessary for the archer to do is to apply a slight thumb pressure against the button 50 which will then result in a release of the member 42 so that, under the force exerted by the bow string 13, the member 42 will swing to the open position illustrated in broken lines at 42*a* of FIG. 2 thereby releasing the bow string.

The latch device is best illustrated in FIGS. 7 through 14. The device 23 includes a housing 60 which consists of a generally rectangular cross section, elongated, rectangular member having a top wall 61, side walls 62 and 63, a partial bottom wall 64 extending outwardly beyond a back wall 65, and a partial front wall 66. The interior is hollow. The side walls 62 and 63 have off-center slots therein 41 which are open to the front of the housing. The pivotable retaining member 42 constitutes a sear latch which is pivoted around a pivot pin 69 mounted in the side faces 62 and 63. The member 42 preferably has a rounded nose portion which spans the area between the slots 41 on one side of the pivot pin and a tail portion 70, best illustrated in FIGS. 9 and 14, which has a slightly rectangular cross section adjacent the pivot pin with a curved or chamfered end edge 71 and a flat wall portion 72.

Disposed within the housing is a latch member 73 which has one end pivotably supported around a pin 74 mounted in the side walls 62 and 63. The latch member has a nose end remote from the pivoted end, the nose end terminating in a flat surface 76 and having a chamfered or undercut portion 77 extending backwardly and downwardly from the nose flat portion 76 to a side wall 78. The purpose of the chamfer 71 and the undercut 77 are to provide mating engageable surfaces so that when the retaining member 42 is in the open position illustrated in FIG. 14 and the latch member 73 is urged thereagainst, the chamfer face 71 will contact the undercut face 77. Thereafter pivoting the member 42 to cause it to assume the slot closing position of FIG. 9 will allow the two faces 71 and 77 to slide on one another until the member 42 is pivoted to the full closed position at which point the latch member will be urged downwardly, in the position illustrated in FIG. 14, until its flat end face 76 overlies the flat side face 72 of the end 70 of the member 42 on the opposite side of the pin 69 from the slot spanning portion of the pivotable retaining member 42.

The end 80 of the latch member 73 received around the pivot 74 is rounded and a spring member 81 is entrapped between the rounded end 80 and a partial bottom 64 of the housing. The spring acts against the latch member 73 to urge it into a pivotable retaining member 42 latched position of FIG. 9 and against an adjustable stop 83. In order to positively anchor the spring with as few parts as possible, the back wall 65 may have two spaced apart openings 84 through which tang ends of the spring project and the base 64 may have a slot 86 through which a downwardly bent intermediate tang 87 of the spring may extend. The bottom wall 64 is firmly attached to the remainder of the housing and includes an opening 90 for receipt of a screw 91 for attachment to the grip 22. The top 61 has an opening 92 therein through which a push trigger button 50 is attached to the latch member 73 as by means of screw 93.

The side walls 62 and 63 may have outturned ear members 97 at their bottoms which can index with side grooves 98 of the slot 37 in the grip 22 to cooperate with the screw 91 in holding the trigger mechanism in the grip 22, or other base mount.

Figure 9:
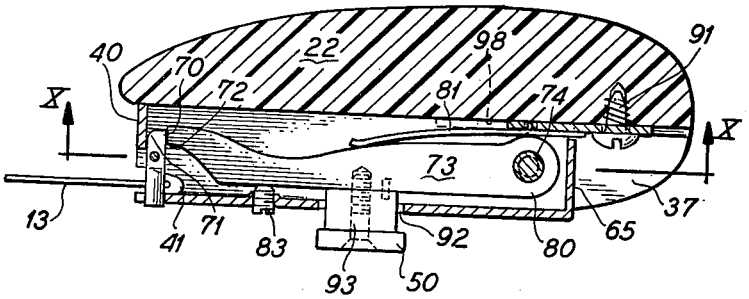
FIG. 9 is a sectional view of the latch device of this invention as installed in the bow string holder.
Figure 10:
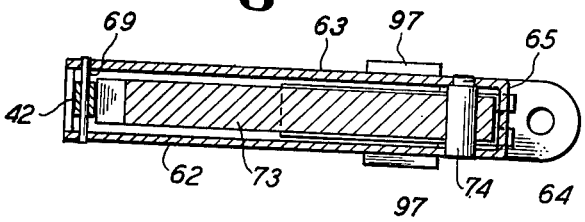
FIG. 10 is a sectional view taken along the lines X—X of FIG. 9.
Figure 11:
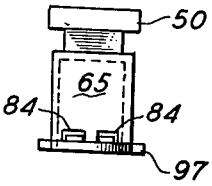
FIG. 11 is a view similar to FIG. 8 illustrating the back side of the latch device.
Figure 12:
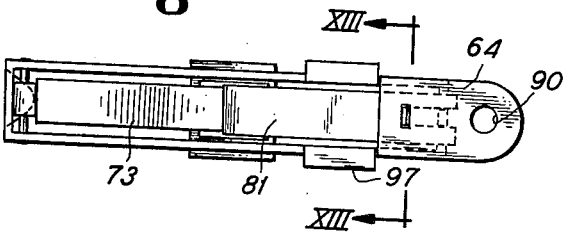
FIG. 12 is a bottom view of the latch device of this invention.
Figure 13:
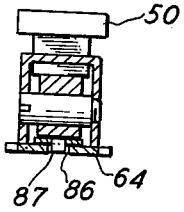
FIG. 13 is a cross-sectional view of the latch device taken along the lines XIII—XIII of FIG. 12.
Figure 14:
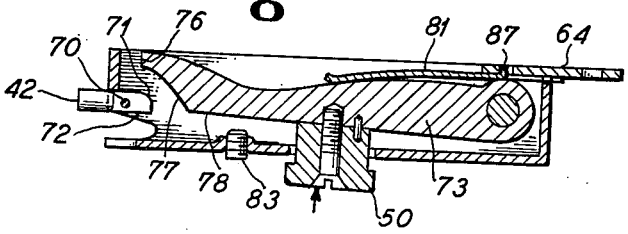
FIG. 14 is a cross-sectional view similar to FIG. 9 illustrating release of the latch device.

From the above, it will be appreciated that when a member such as the string 13 is to be gripped by the latch device 23, it is placed in the slots 41 with the member 42 in the open position illustrated in FIG. 14 where, however, under the influence of the spring 81 the latch will be urged against the adjustable abutment 83. Thereafter the pivotable retaining member 42 is pivoted to the shut position of FIG. 9. During this pivoting the face 71 will contact the face 72 of the latch member causing the latch to move against the spring 81 until the pivotable member 42 has been closed as illustrated in FIG. 9. Thereafter the flat nose face 76 of the latch member will lie against the flat face 72 of the member 42 maintaining it in a closed position. At this time as much force can be applied to the string 13 as is desired and it will be retained attached to the latch device inasmuch as the pivotable member 42 will block exit from the slot.

The degree of overlap between the face 76 of the latch member and the sear is determined by adjustment of the stop 83 so that the latch device may, in effect, be adjusted for the desired hair triggering.

Thereafter when it is desired to release the string 13, a chosen pressure on the button 50 will counteract the spring 81 slipping the latch off of the face 72 of the member 42 allowing it to pivot to a slot opening position illustrated in FIG. 14.

It can therefore be seen from the above that my invention provides a novel bow string holder and release device comprising a grip adapted to be comfortably received in the palm of a hand and having means for releasably gripping a bow string attached to the grip with a release button underlying the thumb of the archer holding the grip. I have also illustrated a novel release mechanism involving a trigger device including a housing having a pivotable sear or retaining member closing a groove-like recess at a front edge of a latch device assembly with a latch member positioned interior of the latch device and pivotable from a point of sear contact to a point where the sear is released to allow the pivotable sear to rotate to open the slot area. A trigger adjustment is described allowing setting of a hair trigger and a simplified construction for the latch device is also provided.

Although the teachings of my invention have herein been discussed with reference to specific theories and embodiments, it is to be understood that these are by way of illustration only and that others may wish to utilize my invention in different designs or applications.

I claim as my invention:

1. A bow string holder and release device for use in archery comprising: a formed grip member having opposed first and second sides and opposed front and back edges interconnecting the sides, the grip member dimensioned to be received in the palm of a user's hand with the fingers of the user overlying a front edge of the grip member and a back edge of the grip member positioned between the fingers and a base of the thumb with a thumb overlying a first side of the grip member, the fingers extending along a second side of the grip member opposite the first side, a latch device carried by the grip member having a bow string engaging member adjacent the front edge of the grip and a trigger release button projecting from the first side of the grip member and underlying the thumb the latch device adopted to grip a bow string parallel to the first and second sides, the latch device including a housing separate from the grip member received in a slot extending along the first side of the grip member open to the front edge of the grip member, the housing having spaced apart side walls with aligned grooves therein open to an end of the side walls at the front edge of the grip member, a pivotable member spanning the area between the side walls in the area of the aligned grooves closing off the grooves when in a latched position and opening the grooves when pivoted from the latched position to a release position, a pivotable latch carried within said housing having an end face engageable with the pivotable member to prevent pivoting from the latched to the release position, the latch pivotable out of contact with the pivotable member by movement against a spring, and a trigger button projecting from the housing attached to the latch on a side opposite engagement of the spring whereby the trigger button can be depressed moving the latch against the spring to release the pivotable member to open the grooves, the grooves dimensioned to receive a bow string when the pivotable member is in the latched position.

2. A bow string holder and release device for use in archery comprising: a formed grip member having opposed first and second sides and opposed front and back edges interconnecting the sides, the grip member dimensioned to be received in the palm of a user's hand with the fingers of the user overlying a front edge of the grip member and a back edge of the grip member positioned between the fingers and a base of the thumb with a thumb overlying a first side of the grip member, the finger extending along a second side of the grip member opposite the first side, a latch device carried by the grip member having a bow string engaging member adjacent the front edge of the grip and a trigger release button projecting from the first side of the grip member and underlying the thumb, the latch device adapted to grip a bow string, the latch device comprises a housing separate from the grip member received in a slot extending along the first side of the grip member open to be the front edge of the grip member, the housing having spaced apart side walls with aligned grooves therein open to an end of the side walls at the front edge of the grip member, a pivotable member spanning the area between the side walls in the area of the aligned grooves closing off the grooves when in a latched position and opening the grooves when pivoted from the latched position to a release position, a pivotable latch carried within said housing having an end face engageable with the pivotable member to prevent pivoting from the latched to the release position, the latch pivotable out of contact with the pivotable member by movement against a spring, and a trigger button projecting from the housing attached to the latch on a side opposite engagement of the spring whereby the trigger button can be depressed moving the latch against the spring to release the pivotable member to open to grooves, the grooves dimensioned to receive a bow string when the pivotable member is in the latch position.

* * * * *